US006003665A

United States Patent [19]

Stout

[11] Patent Number: 6,003,665

[45] Date of Patent: Dec. 21, 1999

[54] BASKET STYLE ARTICLE CARRIER WITH TAPERED END PANELS AND SEPARATOR STRAPS

[75] Inventor: James T. Stout, Ellijay, Ga.

[73] Assignee: The Mead Corporation, Dayton, Ohio

[21] Appl. No.: 08/742,545

[22] Filed: Nov. 1, 1996

[51] Int. Cl.[6] ..... B65D 75/00

[52] U.S. Cl. ..... 206/160; 206/175; 206/191

[58] Field of Search ..... 206/162, 163, 206/170, 174, 175, 180, 181, 183, 190, 191; 229/114

[56] References Cited

U.S. PATENT DOCUMENTS

| | | | |
|---|---|---|---|
| 2,446,161 | 7/1948 | Price | 206/176 |
| 2,453,908 | 11/1948 | Harhay | 206/170 |
| 2,860,816 | 11/1958 | Fielding | 206/190 |
| 4,238,069 | 12/1980 | Morris, Jr. | 229/114 |
| 5,040,672 | 8/1991 | De Maio et al. | 206/162 |
| 5,423,478 | 6/1995 | Roosa | 229/114 |
| 5,505,304 | 4/1996 | Broskow et al. | 206/162 |
| 5,579,904 | 12/1996 | Holley, Jr. | 206/162 |

FOREIGN PATENT DOCUMENTS

| | | | |
|---|---|---|---|
| 2105686 | 3/1983 | United Kingdom | 206/170 |

*Primary Examiner*—David T. Fidei
*Attorney, Agent, or Firm*—Michael V. Drew

[57] ABSTRACT

A set-up basket style article carrier has a bottom panel, first and second opposed sidewalls attached to the bottom panel, riser panels, a handle attached to the riser panels, transverse partition straps extending between the riser panels and sidewalls, and tapered end panels attached to the riser panels. A blank for the article carrier has a bottom panel, a sidewall joined to the bottom panel along a horizontal fold line, a handle assembly panel joined to the sidewall along a horizontal fold line, a tapered end panel joined to the sidewall along a vertical fold line and to the handle assembly panel along horizontally extending fold lines, and a riser panel joined to the end panel along a fold line offset from vertical to accommodate taper in the tapered end panel. Tapering the end panels permits slanting of the sidewalls so that the bottoms of the sidewalls are closer to the center riser panels than the top of the sidewalls, and the bottom area between the sidewalls, riser panels and transverse partition straps is smaller than the top area between the sidewalls, riser panels and transverse partition straps. A container traveling easily through the top area is grasped in the bottom area by a sidewall, riser panel and partition strap or end panel to reduce pressure exerted on the bottom panel and sagging thereby allowing thinner material to be used for the carrier.

16 Claims, 5 Drawing Sheets

BASKET STYLE ARTICLE CARRIER WITH TAPERED END PANELS AND SEPARATOR STRAPS

FIELD OF THE INVENTION

The present invention relates generally to article carriers, and, more particularly, to a basket style article carrier for beverage containers.

BACKGROUND OF THE INVENTION

Basket style carriers are commonly used for carrying beverage bottles. A conventional beverage bottle is typically the same diameter at its base and its midsection which tapers into a smaller neck. Some contemporary beverage bottles tend to have a larger midsection that tapers to a smaller base. While increasing aesthetic appeal, tapered bottles are also easier to insert into basket style carriers. Unfortunately, when a carrier is loaded with tapered bottles, there is an undesirable tendency for the bottom and other portions of the carrier to sag due to the weight of the bottles. Sagging can be prevented by using thicker material to construct the carrier, but using thicker material increases cost which is undesirable. Therefore, it will be appreciated that it would be highly desirable to have a basket style carrier constructed of thin stock but which does not sag when loaded.

SUMMARY OF THE INVENTION

The present invention is directed to overcoming one or more of the problems set forth above. Briefly summarized, according to one aspect of the present invention, a basket style article carrier comprises a bottom panel, first and second opposed sidewalls attached to the bottom panel, riser panels, a handle attached to the riser panels, transverse partition straps extending between the riser panels and sidewalls, and tapered end panels attached to the riser panels.

Tapering the end panels facilitates slanting the sidewalls so that the bottoms of the sidewalls are closer to the center riser panels than the top of the sidewalls and the bottom area between the sidewalls, riser panels and transverse partition straps is smaller than the top area between the sidewalls, riser panels and transverse partition straps. A container traveling easily through the top area is grasped in the bottom area by a sidewall, riser panel and partition strap or end panel to reduce pressure exerted on the bottom panel thereby allowing thinner material to be used for the carrier.

According to another aspect of the invention, a blank for a basket style article carrier, comprises a bottom panel, a sidewall joined to the bottom panel along a horizontal fold line, a handle assembly panel joined to the sidewall along a horizontal fold line, a tapered end panel joined to the sidewall along a vertical fold line and to the handle assembly panel along horizontally extending fold lines, and a riser panel joined to the end panel along a fold line offset from vertical to accommodate taper in the tapered end panel.

When assembled using the fold lines the tapered end panel facilitates slanting the sidewall so that the bottom of the sidewall is closer to the center riser panel than the top of the sidewall creating a bottom area between the sidewall and riser panel that is smaller than the top area between the sidewall and riser panel. A container traveling easily through the top area is grasped in the bottom area by the sidewall and riser panel to reduce pressure exerted on the bottom panel thereby allowing thinner material to be used for the carrier.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
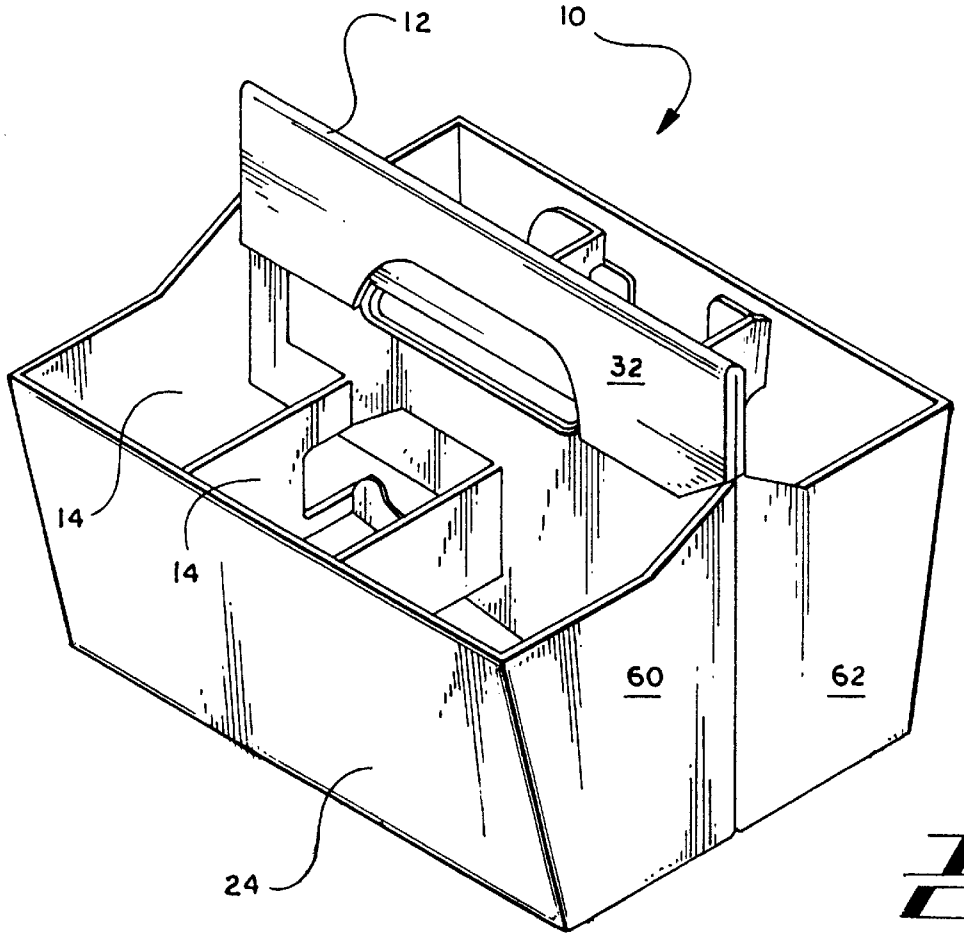
FIG. 1 is a perspective view of a preferred embodiment of a set-up carrier with tapered end panels according to the present invention.
Figure 2:
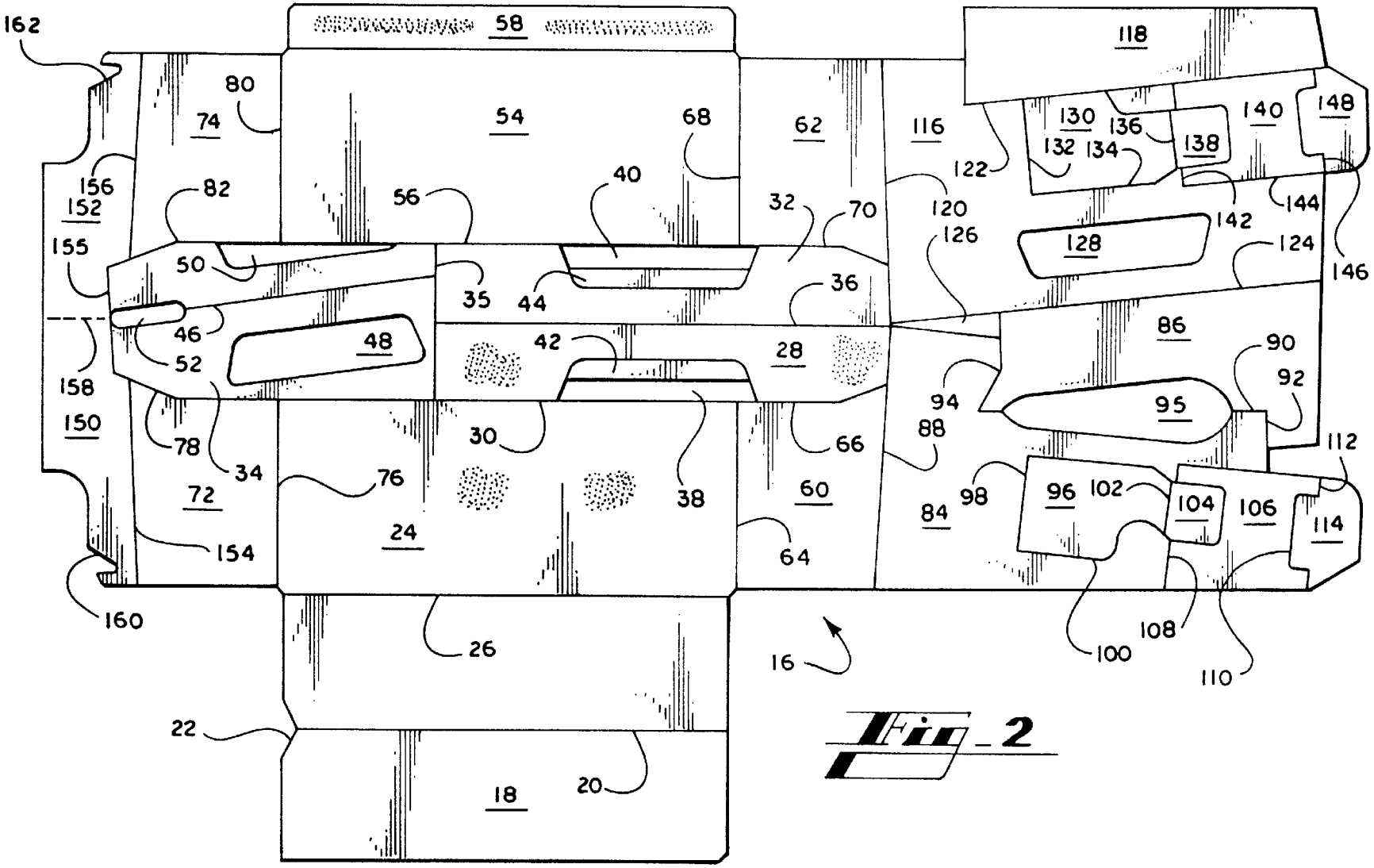
FIG. 2 is a plan view of a blank from which the carrier of FIG. 1 is formed.

Referring to FIGS. 1 and 2, a basket style article carrier 10 has a handle 12 and a plurality of cells 14 for carrying articles, such as containers of beverage. The cells 14 are tapered to better grip the containers thereby preventing the carrier from sagging. Because sagging is not a problem with the tapered cells, the carrier can be constructed of thinner material. The article carrier 10 is formed from a blank 16 of material in which several selected areas are removed to construct the handle 12. The blank 16 contains a number of cuts to form individual panels and contains fold lines along which the panels are folded to assemble the carrier. The outside of the carrier 10 (shown face down in FIG. 2) may be printed or decorated or covered with decorative foil or paper for aesthetic appeal.

Referring to FIG. 2, the blank 16 for basket style article carrier 10 has a bottom panel 18 with first and second opposed side edges, first and second opposed end edges and a horizontal fold line 20 extending between the end edges. Horizontal fold line 20 divides the bottom panel 18 into two sections that fold flat along the fold line 20 against one another when the carrier 10 is folded for storage or shipping. The second end edge of the bottom panel 18 provides a notch 22 forming a female locking member.

The first sidewall 24 has first and second side edges and first and second end edges and is joined to the second side of the bottom panel 18 along a horizontal fold line 26 at the first side of the first sidewall 24. When assembled, the first sidewall 24 stands generally upright from the bottom panel 18 along the fold line 26.

A handle assembly panel 28 has first and second side edges and first and second end edges and is joined to the second side of the first sidewall 24 along a horizontal cut line 30 at the first side of the handle assembly panel 28. Handle assembly panel 28 contains an outer panel 32 and an inner panel 34 joined along a vertical cut line 35. Outer panel 32 is divided by a horizontal fold line 36 into two symmetric portions each having a cutout 38, 40 for forming a handle opening and a flap 42, 44 to be folded to provide cushioning for the hand of a user. Inner panel 34 is divided by a horizontally extending fold line 46 into two nonsymmetric portions each having a cutout 48, 50 for forming the handle opening and a third cutout 52 centered along the fold line 46 at the end of the inner panel 34 distal from the outer panel 32. When assembled, the handle 12 is a multiple-ply handle that has the two portions of the outer panel 32 facing one another and the two portions of the inner panel 34 facing one another and positioned between the outer panel portions.

A second sidewall 54, which is a mirror image of the first sidewall 24, also has first and second side edges and first and second end edges and is joined to the second side of the handle assembly panel 28 along a horizontal cut line 56 at the first side of the second sidewall 54. A glue flap 58 extends from the second side edge of the second sidewall 54 for fastening the second sidewall to the first side edge of the bottom panel 18. To stiffen the glue flap 58, reinforcing ribs or embossing may be used.

A first end panel assembly has a first tapered end panel 60 with first and second side edges and a second tapered end panel 62 also with first and second side edges. The first end panel 60 is joined along its first side to the first end of the first sidewall 24 along a vertical fold line 64 and to the first end of the handle assembly panel 28 along horizontally extending cut lines 66. The second end panel 62 is joined along its first side to the first end of the second sidewall 54 along a vertical fold line 68 and to the first end of the handle assembly panel 28 along horizontally extending cut lines 70. The second sides of the end panels 60, 62 are slanted to taper the panels. When assembled, the tapered end panels 60, 62 cause the sidewalls 24, 54 to slant outward slightly from the bottom panel 18. Preferably, the degree of taper is about 5° or so, but can vary depending on the taper of the associated containers for the cells. With a taper of about 5° or so, the horizontally and vertically extending cut lines and fold lines will also vary about 5° or so. When the degree of taper is less than about 2°, the cells do not effectively grip the lower portion of the container to prevent sagging. If the degree of taper is more than about 8° or so, the cells grip the lower portion of the container too tightly, but not the upper portion, which promotes carrier sagging.

A second end panel assembly has a first tapered end panel 72 with first and second side edges and a second tapered end panel 74 with first and second side edges. The first end panel 72 is joined along its first side to the second end of the first sidewall 24 along a vertical fold line 76 and to the second end of the handle assembly panel 28 along horizontally extending fold lines 78. Likewise, the second end panel 74 is joined along its first side to the second end of the second sidewall 54 along a vertical fold line 80 and to the second end of the handle assembly panel 28 along horizontally-extending fold lines 82. The second end panel assembly 28 is a mirror image of the first end panel assembly.

A first riser panel assembly having a first riser panel 84 with first and second sides and first and second ends and a second riser panel 86 with first and second sides and first and second ends. The first riser panel 84 is joined along its first side to the second side of the first end panel 60 of the first end panel assembly along a vertically extending fold line 88 offset from vertical to accommodate taper in the first tapered end panel 60. The first and second riser panels 84, 86 are joined to one another along horizontal fold line 90 and vertical cut lines 92, 94. A handle cutout 95 exists between the riser panels 84, 86 along the horizontal fold line 90. When assembled, these riser panels enjoy face contact with one another and become part of the medial partition of the carrier.

The first riser panel assembly contains a first transverse partition strap 96 in the first riser panel 84 attached thereto along vertically-extending fold line 98 and cut line 100. Fold line 102 allows folding so that when the carrier is assembled flap 104 is attached to sidewall 24 to form one of the cells 14. Similarly, a second transverse partition strap 106 in the first riser panel 84 is attached thereto along vertically-extending fold line 108 and cut line 110. Fold line 112 allows folding so that when the carrier is assembled flap 114 is attached to sidewall 24 to form another one of the cells 14.

The second riser panel assembly is not symmetrical with the first riser panel assembly, but it is similar. It has a first riser panel 116 with first and second sides and first and second ends and a second riser panel 118 with first and second sides and first and second ends. The first riser panel 116 is joined along its first side to the second side of the second end panel 62 of the first end panel assembly along a vertically extending fold line 120 offset from vertical to accommodate taper in the first tapered end panel 62. The first and second riser panels 116, 118 are joined to one another along horizontal fold line 122. At its bottom edge riser panel 116 is adjacent to riser panel 86 along horizontally extending cut line 124. A cutout 126 is defined in part by border cut line 124 between riser panels 84, 86 and 114. A handle cutout 128 in riser panel 116 is vertically displaced from cut line 124. When assembled, riser panels 116, 118 have face contact with one another and become part of the medial partition of the carrier.

The second riser panel assembly contains a first transverse partition strap 130 in the first riser panel 116 attached thereto along vertically extending fold line 132 and cut line 134. Fold line 136 allows folding so that when assembled flap 138 is attached to sidewall 54 to form one of the cells 14. Similarly, a second transverse partition strap 140 in the first riser panel 116 is attached thereto along vertically extending fold line 142 and cut line 144. Fold line 146 allows folding so that when the carton is assembled flap 148 is attached to sidewall 54 to form another one of the cells 14.

The other end of the blank 16 contains a third riser panel assembly having a first riser panel 150 with first and second sides and first and second ends and a second riser panel 152 with first and second sides and first and second ends. The first riser panel 150 is joined along its first side to the second side of the first end panel 72 of the second end panel assembly along a vertically extending fold line 154 offset from vertical to accommodate taper in the first tapered end panel 72. They are also connected along vertically extending fold line 155. The second riser panel 152 is symmetric to the first riser panel 150 and is joined along its first side to the second side of the second end panel 74 of the second end panel assembly along a vertically extending fold line 156 offset from vertical to accommodate taper in the second tapered end panel 74. They also share common fold line 155. The first and second riser panels 150, 152 are joined to one another along horizontal fold line 158. The second sides of the riser panels 150, 152 contain notches 160, 162 to form a male locking member.

Basket style article carrier 10 is assembled from the paper blank 16 by removing the cutouts 48, 50 52, 95 and 126 and applying glue to selected areas of sidewall 24 and outer handle panel 32 as indicated by stippling in FIG. 2. Alternatively, glue may be applied to flaps 104 and 114 instead of outer panel 32. The blank is then folded to the position shown in FIG. 3 wherein the first riser panel 84 is brought up and folded along vertically extending fold line 88 into contact with the first sidewall 24, end panel 60 and glue bearing areas of outer panel 32. The flaps 104, 114 are brought into contact with the glue on sidewall 24. As panel 84 is raised up to be folded, the second riser panel 86 is folded backward onto riser panel 84. Ribs now visible on the face of the partition straps 96, 106 cause material surrounding each rib to puff out increasing the thickness of the straps to maintain a predetermined amount of separation between containers.

Figure 3:
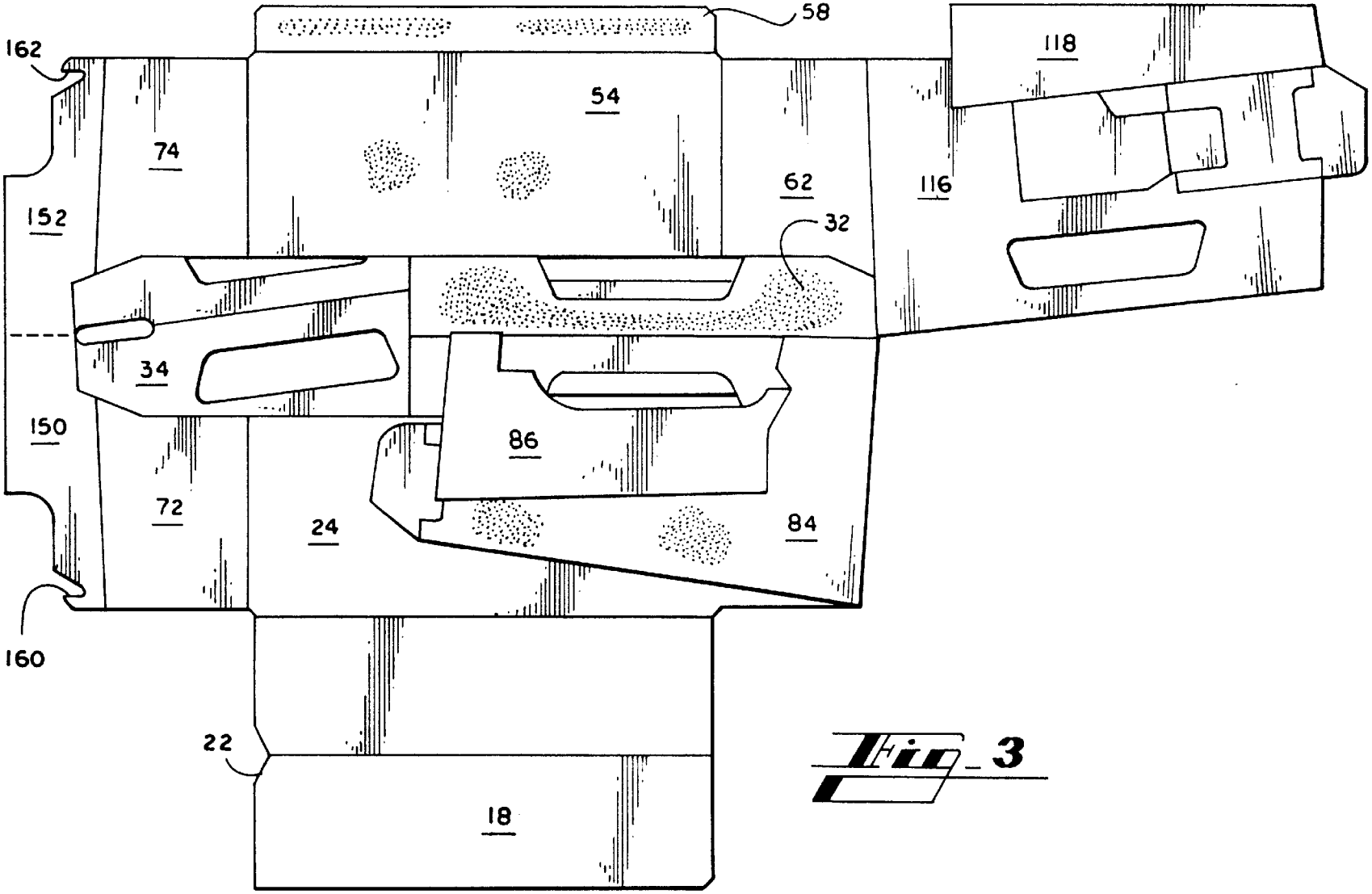

Assembly continues by applying glue to selected areas of the second sidewall 54 and outer handle panel 32 as indicated by stippling in FIG. 3. The blank is then folded to the position shown in FIG. 4 wherein riser panel 116 is brought up and folded along vertically extending fold line 120 into contact with sidewall 54, end panel 62 and glue bearing areas of outer panel 32. The flaps 138, 148 are brought into contact with the glue on sidewall 54. As panel 116 is raised up to be folded, riser panel 118 is folded backward onto riser panel 116. Ribs now visible on the face of the partition straps 130, 140 as well riser panel 118.

Figure 4:
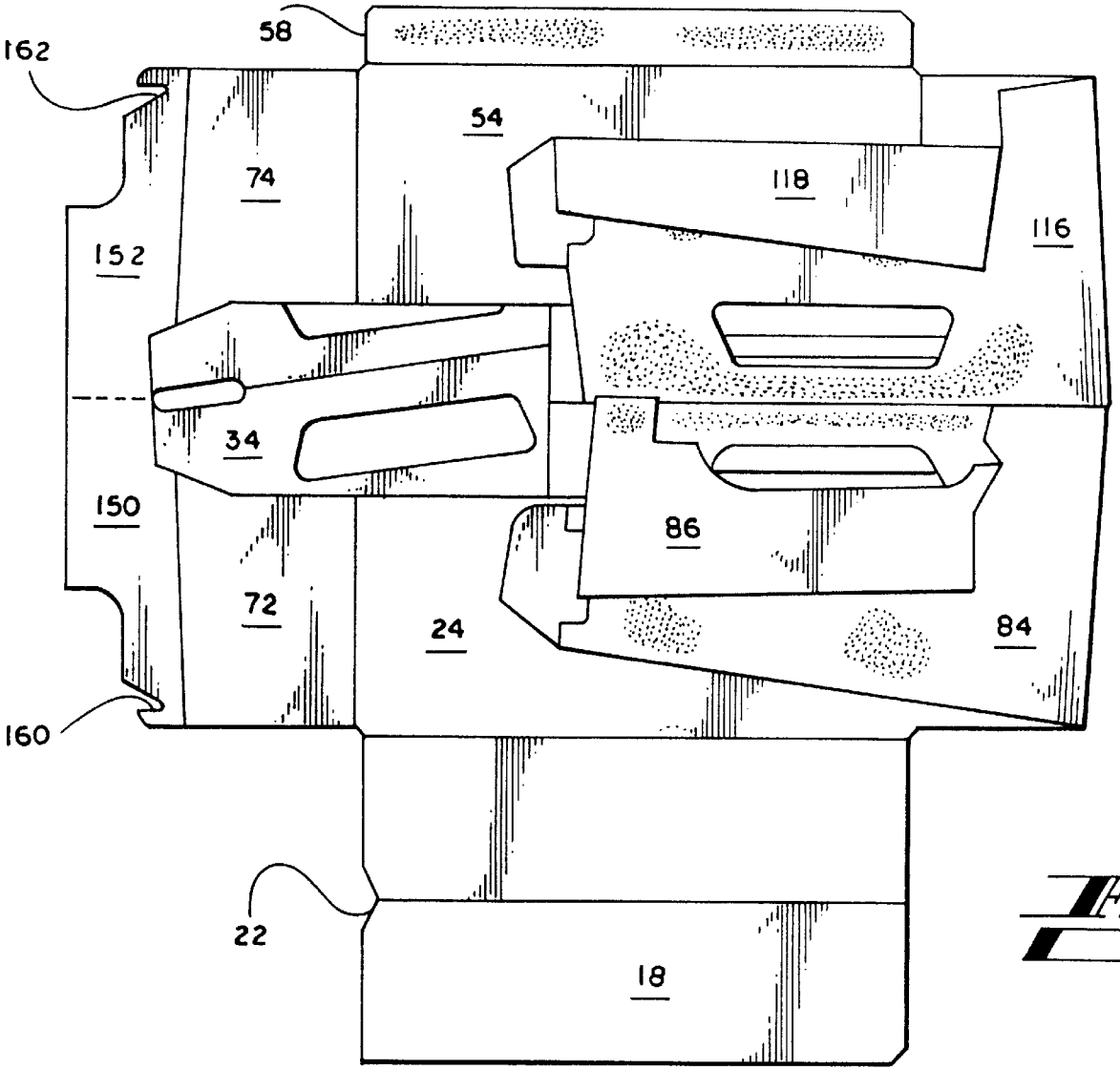
Figure 5:
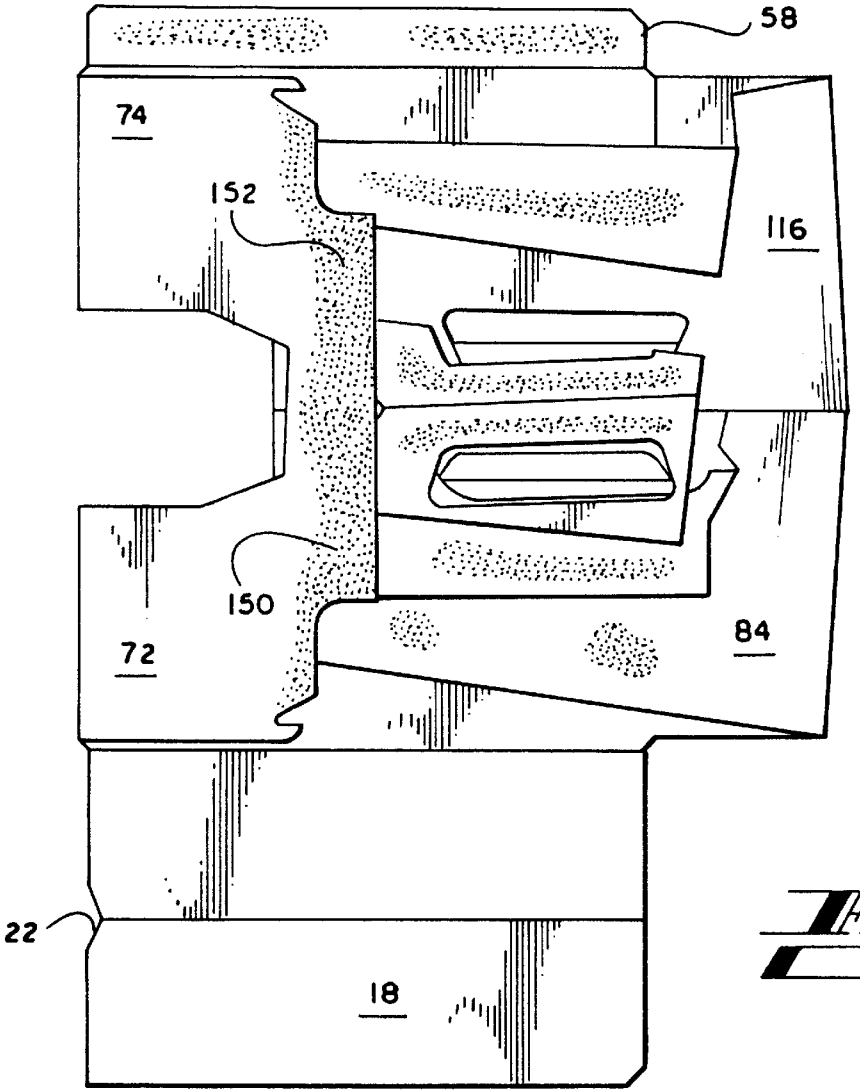

With the first and second riser panel assemblies folded as in FIG. 4, glue is applied to selected areas of riser panels 86, 116 and outer handle panel 32 as indicated by stippling. At this point, inner handle panel 34 is lifted and moved to the right to overlay outer handle panel 32. As inner panel 34 is lifted it begins to fold along fold line 155 and end panels 72, 74 begin to fold inward along fold lines 76, 80. Handle panels 32, 34 are nested as shown in FIG. 5, and end panels 72, 74 respectively overlay sidewalls 18, 54, and riser panels 150, 152 respectively overlay sidewalls 18, 54 with notches 160, 162 now opening inward instead of outward. At this point the multi-ply handle is connected at each end to the riser panels.

Figure 7:
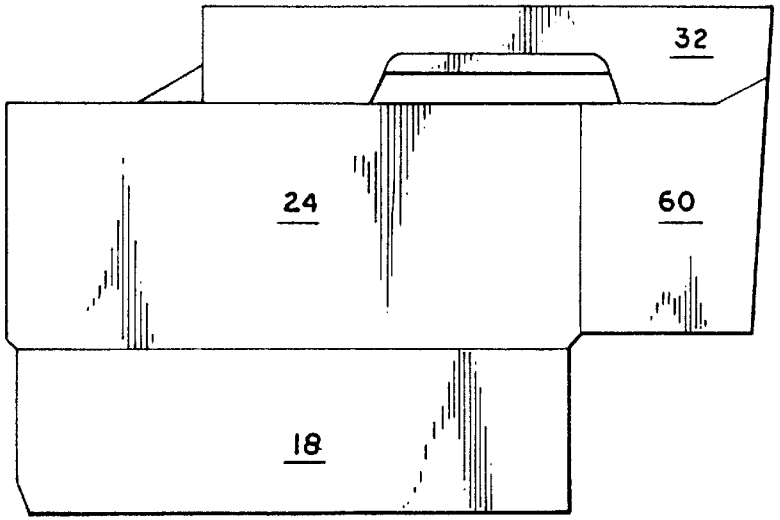
FIGS. 3–7 illustrate stages through which the blank of FIG. 2 is manipulated to form the carrier of FIG. 1.
Figure 6:
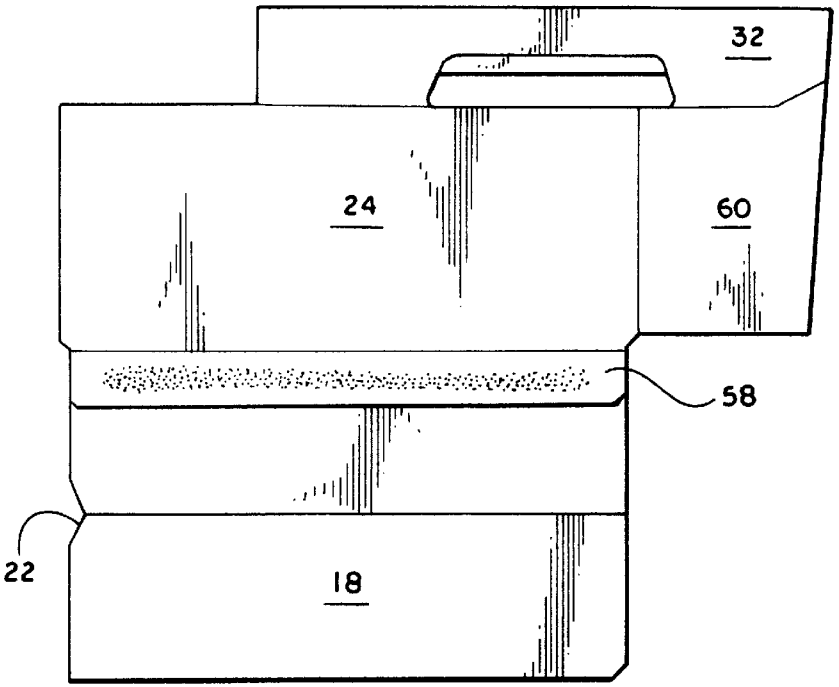

With the riser panels folded as in FIG. 5, glue is applied to selected areas of riser panels 86, 116, 150, 152 and handle panels 32, 34 as indicated by stippling. Folding along horizontal fold lines 36, 158 brings sidewall 54 over onto sidewall 18 as shown in FIG. 6. The final assembly step is applying glue to glue flap 58 and folding bottom panel 18 along its horizontal fold line 20 so that its bottom side edge joins the glue flap as shown in FIG. 7.

It can now be appreciated that a basket style article carrier with tapered end panels has been presented. Tapering the end panels allows the sidewalls to slant so that the bottoms of the sidewalls are closer to the center riser panels than the top of the sidewalls, and the bottom area between the sidewalls, riser panels and transverse partition straps is smaller than the top area between the sidewalls, riser panels and transverse partition straps. The carrier is loaded by unfolding it and engaging the male and female locking members to hold the cells open. Containers are then lowered into the cells. A container lowers easily through the top area of a cell but is grasped slightly in the bottom area of a cell by a sidewall, riser panel and partition strap or end panel. When the filled carrier is lifted, the bottom portion of the cell tightens its grip on the container to reduce pressure exerted on the bottom panel thereby allowing thinner material to be used for the carrier without fear of sagging.

When assembling the carrier blank into a set-up carrier using the fold lines, the tapered end panel facilitates slanting the sidewall so that the bottom of the sidewall is closer to the center riser panel than the top of the sidewall creating a bottom area between the sidewall and riser panel that is smaller than the top area between the sidewall and riser panel. A container fitting easily through the top area is grasped in the bottom area by the sidewall and riser panel to reduce pressure exerted on the bottom panel when the carrier is loaded and lifted thereby allowing thinner material to be used for the carrier.

A set-up basket style article carrier has a bottom panel, first and second opposed sidewalls attached to the bottom panel, riser panels, a handle attached to the riser panels, transverse partition straps extending between the riser panels and sidewalls, and tapered end panels attached to the riser panels. A blank for the article carrier has a bottom panel, a sidewall joined to the bottom panel along a horizontal fold line, a handle assembly panel joined to the sidewall along a horizontal fold line, a tapered end panel joined to the sidewall along a vertical fold line and to the handle assembly panel along horizontally-extending fold lines, and a riser panel joined to the end panel along a fold line offset from vertical to accommodate taper in the tapered end panel. Tapering the end panels permits slanting of the sidewalls so that the bottoms of the sidewalls are closer to the center riser panels than the top of the sidewalls, and the bottom area between the sidewalls, riser panels and transverse partition straps is smaller than the top area between the sidewalls, riser panels and transverse partition straps.

While the invention has been described with particular reference to a basket carrier for carrying beverage bottles, it is apparent that the carrier is suitable for other containers. As is evident from the foregoing description, certain aspects of the invention are not limited to the particular details of the examples illustrated, and it is therefore contemplated that other modifications and applications will occur to those skilled in the art. For example, the carrier can be assembled from the blank using a different sequence of steps than described. Also, while a unitary blank is preferred, a multi-piece blank can be used. It is accordingly intended that the claims shall cover all such modifications and applications as do not depart from the true spirit and scope of the invention.

What is claimed is:

1. A basket style article carrier, comprising:

a bottom panel having first and second opposed side edges;

first and second opposed sidewalls, said first sidewall having first and second ends and being foldably joined to said second side edge of said bottom panel, said second sidewall having first and second ends and being foldably joined to said first side edge of said bottom panel, said sidewalls angling inward toward one another;

a first end panel assembly having first and second tapered end panels, said first tapered end panel thereof being foldably joined to said first end of said first sidewall and extending transversely inward therefrom, said second tapered end panel being foldably joined to said first end of said second sidewall and extending transversely inward therefrom;

a second end panel assembly having first and second tapered end panels, said first tapered end panel thereof being foldably joined to said second end of said first sidewall and extending transversely inward therefrom, said second tapered end panel being foldably joined to said second end of said second sidewall and extending transversely inward therefrom;

a first riser panel assembly having first and second riser panels, said first riser panel thereof being foldably joined to said first tapered end panel of said first end panel assembly, said second riser panel thereof being foldably joined to said first riser panel thereof and secured thereto in face contacting relation inward of said first riser panel thereof;

a first transverse partition strap foldably extending from said first riser panel of said first riser panel assembly and foldably attached to said first sidewall;

a second riser panel assembly having first and second riser panels, said first riser panel thereof being foldably joined to said second tapered end panel of said first end panel assembly, said second riser panel thereof being foldably joined to said first riser panel and secured thereto in face contacting relation inward of said first riser panel;

a second transverse partition strap foldably extending from said first riser panel of said second riser panel assembly and foldably attached to said second sidewall; and a handle connected to said riser panels.

2. A basket style article carrier, as set forth in claim 1, wherein the first and second riser panels of said first riser panel assembly define a handle opening.

3. A basket style article carrier, as set forth in claim 1, wherein said first riser panel of said second riser panel assembly defines a handle opening.

4. A basket style article carrier, as set forth in claim 1, wherein said first end panel of said first end panel assembly and said first sidewall are joined along a first line and said first end panel and said first riser panel of said first riser panel assembly are joined along a second line not parallel to said first line so that a bottom portion of said first sidewall lies closer to said first riser panel than a top portion of said first sidewall.

5. A basket style article carrier, as set forth in claim 1, wherein said first riser panels are in face-contacting relationship with one another.

6. A basket style article carrier, as set forth in claim 1, wherein said second riser panels are in face-contacting relationship with one another.

7. A basket style article carrier, as set forth in claim 1, wherein said handle is a multi-ply handle connected at each end to said first riser panel and said second riser panel of said first riser panel assembly.

8. A basket style article carrier, as set forth in claim 1, wherein said handle has a pair of opposed outer panels facing one another and a pair of intermediate panels disposed between said outer panels.

9. A basket style article carrier, as set forth in claim 1, wherein said bottom panel has first and second opposed end edges with said second end edge defining a notch forming a female lock.

10. A basket style article carrier, as set forth in claim 1, wherein said first transverse partition strap and said first riser panel are joined along a first line and said first transverse partition strap and said first sidewall are joined along a second line not parallel to said first line so that a bottom portion of said first sidewall lies closer to said first riser panel than a top portion of said first sidewall.

11. A basket style article carrier, as set forth in claim 1, including;

a third transverse partition strap foldably extending from said first riser panel of said first riser panel assembly and foldably attached to said first sidewall; and a fourth transverse partition strap foldably extending from said first riser panel of said second riser panel assembly and foldably attached to said second sidewall.

12. A basket style article carrier, as set forth in claim 1, including;

a third riser panel having an edge portion defining a notch forming a male lock member, said third riser panel being foldably joined to said first end panel of said second end panel assembly; and a fourth riser panel having an edge portion defining a notch forming a male lock member, said fourth riser panel being foldably joined to said second end panel of said second end panel assembly, said third riser panel being foldably joined to said fourth riser panel and secured thereto in face contacting relation inward of said second end panel assembly.

13. A blank for a basket style article carrier, comprising:

a bottom panel having first and second opposed sides and a horizontal fold line;

a first sidewall having first and second sides and first and second ends and being joined to said second side of said bottom panel along a horizontal fold line at said first side of said first sidewall;

a handle assembly panel having first and second sides and first and second ends and being joined to said second side of said first sidewall along a horizontal fold line at said first side of said handle assembly panel;

a second sidewall having first and second sides and first and second ends and being joined to said second side of said handle assembly panel along a horizontal fold line at said first side of said second sidewall;

a first end panel assembly having a first tapered end panel with first and second sides and a second tapered end panel with first and second sides, said first end panel being joined along said first side to said first end of said first sidewall along a vertical fold line and to said first end of said handle assembly panel along horizontally extending fold lines, said second end panel being joined along said first side to said first end of said second sidewall along a vertical fold line and to said first end of said handle assembly panel along horizontally extending fold lines;

a first riser panel assembly having a first riser panel with first and second sides and first and second ends and a second riser panel with first and second sides and first and second ends, said first riser panel being joined along said first side to said second side of said first end panel of said first end panel assembly along a fold line offset from vertical to accommodate taper in said first tapered end panel, said second riser panel being joined along said first side to said second side of said second end panel of said first end panel assembly along a fold line offset from vertical to accommodate taper in said second tapered end panel;

a second end panel assembly having a first tapered end panel with first and second sides and a second tapered end panel with first and second sides, said first end panel being joined along said first side to said second end of said first sidewall along a vertical fold line and to said second end of said handle assembly panel along horizontally extending fold lines, said second end panel being joined along said first side to said second end of said second sidewall along a vertical fold line and to said second end of said handle assembly panel along horizontally extending fold lines; and a second riser panel assembly having a first riser panel with first and second sides and first and second ends and a second riser panel with first and second sides and first and second ends, said first riser panel being joined along said first side to said second side of said first end panel of said second end panel assembly along a fold line offset from vertical to accommodate taper in said second tapered end panel, said second riser panel being joined along said first side to said second side of said second end panel of said second end panel assembly along a fold line offset from vertical to accommodate taper in said second tapered end panel.

14. A blank, as set forth in claim 13, including a glue flap extending from one of said bottom panel and second sidewall for fastening said second sidewall and bottom panel.

15. A blank, as set forth in claim 13, including:

a first transverse partition strap attached along fold lines to said first riser panel of said first riser panel assembly, a second transverse partition strap attached along fold lines to said second riser panel of said first riser panel assembly.

16. A blank, as set forth in claim 15, including:

a third transverse partition strap attached along fold lines to said first riser panel of said first riser panel assembly, a fourth transverse partition strap attached along fold lines to said second riser panel of said first riser panel assembly.

* * * * *